US005198641A

United States Patent [19]

Nagano et al.

[11] Patent Number: 5,198,641

[45] Date of Patent: Mar. 30, 1993

[54] SHEATHED HEATER

[75] Inventors: Shigetoshi Nagano, Tokyo; Akira Takanaka; Akira Sogabe, both of Chiba, all of Japan

[73] Assignee: Sakaguchi Dennetsu Kabushiki Kaisha, Tokyo, Japan

[21] Appl. No.: 839,599

[22] Filed: Feb. 21, 1992

[30] Foreign Application Priority Data

Feb. 26, 1991 [JP] Japan ..... 3-53256

[51] Int. Cl.[5] ..... H05B 3/48; H05B 3/46

[52] U.S. Cl. ..... 219/544; 219/523; 219/534; 338/238; 338/243

[58] Field of Search ..... 219/544, 523, 534; 338/229, 230, 238-242, 244-251

[56] References Cited

U.S. PATENT DOCUMENTS

| | | | |
|---|---|---|---|
| 2,916,594 | 12/1959 | Sawyer | 219/544 |
| 3,476,916 | 11/1969 | La Vaw | 219/544 |
| 3,839,623 | 10/1974 | Portmann | 219/544 |
| 4,280,046 | 7/1981 | Shimotori et al. | 219/544 |
| 4,742,324 | 5/1988 | Shida et al. | 338/238 |

FOREIGN PATENT DOCUMENTS

| | | | |
|---|---|---|---|
| 1138077 | 6/1957 | France . | |
| 2392162 | 12/1973 | France . | |
| 2224962 | 10/1974 | France . | |
| 2273437 | 12/1975 | France . | |
| 2443182 | 6/1980 | France . | |
| 155690 | 9/1983 | Japan . | |
| 157079 | 9/1983 | Japan . | |
| 157080 | 9/1983 | Japan . | |
| 79/00924 | 11/1979 | PCT Int'l Appl. . | |
| 259610 | 4/1927 | United Kingdom | 219/534 |
| 1101275 | 1/1968 | United Kingdom . | |

*Primary Examiner*—Bruce A. Reynolds
*Assistant Examiner*—Michael D. Switzer
*Attorney, Agent, or Firm*—Nilles & Nilles

[57] ABSTRACT

A sheathed heater wherein before the sheathed heater is assembled, an oxide film is formed on the inner peripheral surface of a metal pipe, and/or the outer surfaces of an internal heater and lead pins thereof which are inserted into the metal pipe by heating them in the presence of oxygen or by applying chemicals thereto, and a heat resistent insulation material member is filled in a space formed between the metal pipe and the internal heater. The color of the oxide film thus formed is light brown, brown or black.

21 Claims, 3 Drawing Sheets

SHEATHED HEATER

BACKGROUND OF THE INVENTION

1. Field of the Invention

This invention relates to a sheathed heater, and more particularly to an improvement of a sheathed heater for use at a higher temperature atmosphere.

2. Description of the Prior Art

In the conventional sheathed heater or cartridge heater, a metal pipe, such as a stainless steel pipe is used. Accordingly, if the sheathed heater is used at a high temperature atmosphere of more than 600° C., a leakage current which flows to the metal pipe from the internal heater coil or resistance coil is increased, because the insulation resistance of the heat insulating material member, such as magnesia which is filled in the metal pipe is decreased according to the elevation of the temperature. When the leakage current is increased over a predetermined value, the circuit breaker of the power source for the sheathed heater is activated to break the power circuit. If a plurality of sheathed heaters are used at the same time, the circuit breaker would often be activated to break the power circuit. Thus, the heating operation cannot be carried out effectively.

FIGS. 1 and 2 show a conventional sheathed heater 30 comprising a metal pipe 31, such as stainless steel pipe, a bottom plate 32 covering the metal pipe 31 at a bottom portion thereof, a core of porcelain insulator 33 arranged at the center of the metal pipe 31, a pair of lead pins 34 having base portions which are inserted into small holes formed in and passing through the core of porcelain insulator 33, a heater coil 35 would around. the core of porcelain insulator 33, and a heat resistive insulation material member 37 filled in a space formed between the metal pipe 31 and the core of porcelain insulator 33.

In such sheathed heater 30, the insulation resistance of the insulation material member 37 filled in the metal pipe 31 is decreased according to the elevation of the temperature, in case that the sheathed heater is used at a high temperature atmosphere of more than 600° C. Accordingly, a leakage current which flows to the metal pipe 31 from the internal heater coil 35 through the insulation material member 37 is increased so that the circuit breaker (not shown) inserted between the sheathed heater and the power source thereof is activated to break the heating operation. This causes the heating operation to be reduced in efficiency. Further, if a plurality of sheathed heaters are used, the operator must find the sheathed heater the leakage current of which has become large and replace it, and then the circuit breaker must be deactivated with much labor and time.

Further, there are given hitherto manufacturing methods of the sheathed heater as disclosed in Japanese Patents Laid-Open Nos. 155690/83, 157080/83 and 157079/83. In the method shown in the Japanese Patent Laid-Open No. 155690/83, a thin metal plate or metal wire is inserted between the metal pipe and the heater coil. After the sheathed heater is assembled, the metal plate is oxidized in order to prevent the vaporization of the heater coil so that the insulation resistance of the heat insulating material member, such as magnesia, is prevented from being reduced.

However, this plate is incapable of sufficiently reducing the leakage current which flows from the heater coil to the metal pipe at a high temperature atmosphere of more than 600° C.

In the Japanese Patent Laid-Open No. 157080/83, the inner peripheral surface of the metal pipe is coated with a paint including metal oxide powder in order to prevent the vaporization of the device discussed heater coil to attain the same purpose of the device discussed above. However, this arrangement is also incapable of sufficiently inducing the leakage current at a high temperature atmosphere of more than 600° C. It is also very difficult to coat uniformly the entire inner peripheral surface of the metal pipe with the paint. Further, this method is complex and expensive.

In the Japanese Patent Laid-Open No. 157079/83, the inner peripheral surface of the metal pipe is coated with a metal and, after the sheathed heater is assembled, the metal is oxidized with heat to attain the same purpose of the device discussed above. However, in this sheathed heater, the leakage current cannot be reduced sufficiently at a high temperature atmosphere of more than 600° C. as mentioned above.

SUMMARY OF THE INVENTION

An object of the present invention is to reduce the leakage current in a sheathed heater, which current flows from the internal heater to the metal pipe, so that the sheathed heater can be used at a high temperature atmosphere of more then 600° C.

The above object can be attained by a sheathed heater comprising a metal pipe of which the entire inner peripheral surface has been oxidized previously, an internal heater being inserted into the metal pipe, with lead pins connected to both ends of the heater, respectively, and a heat resistive insulation material member being filled in a space formed between the metal pipe and the internal heater.

The above object can also be attained by a sheathed heater comprising a metal pipe, an internal heater inserted into the metal pipe, lead pins connected to both ends of the heater, respectively, and a heat resistive insulation material member filled in a space formed between the metal pipe and the internal heater, the outer surfaces of the internal heater and lead pins having been oxidized previously.

According to the sheathed heater of the present invention, the leakage current which flows from the internal heater to the metal pipe can be reduced enough, even if the sheathed heater is used at a high temperature atmosphere of more than 600° C., because a sufficient oxide film having a good insulating ability at a high temperature is formed very easily on the entire inner surface of the metal pipe or the outer surfaces of the heater and lead pins by subjecting them at a higher temperature atmosphere in the presence of sufficient oxygen, or subjecting them to chemicals, such as an oxydizing agent.

Other objects and features of the present invention will become apparent from the following description taken in conjunction with the accompanying drawings.

DESCRIPTION OF THE PREFERRED EMBODIMENTS

Figure 1:
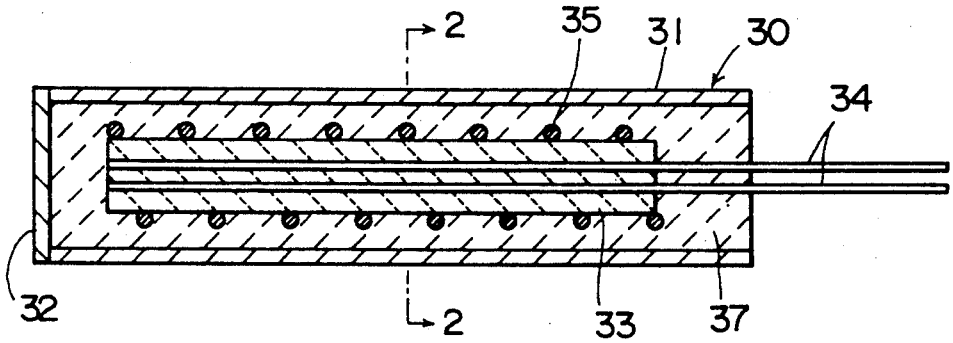
F I G . 1 PRIOR ART
FIG. 1 is a sectional side view of a conventional sheathed heater.
Figure 2:
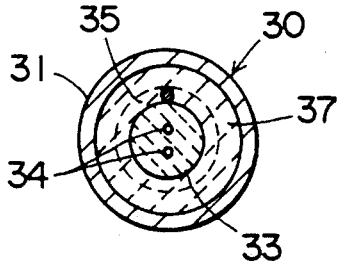
F I G . 2 PRIOR ART
FIG. 2 is a vertical sectional view taken along a line 2—2 in FIG. 1
Figure 3:
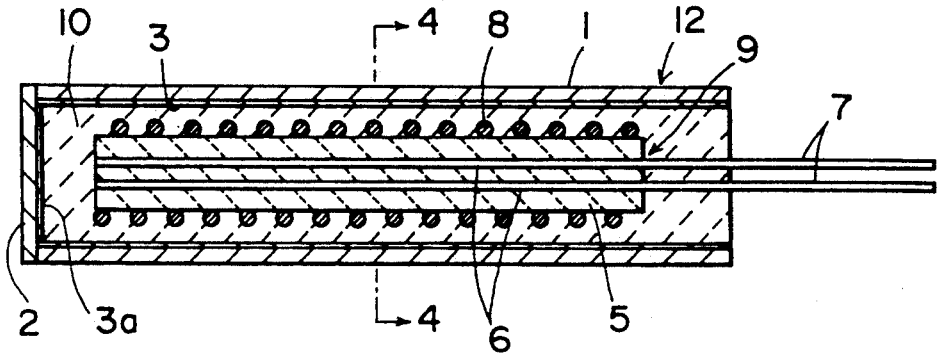
FIG. 3 is a sectional side view of a sheathed heater according to the present invention.
Figure 4:
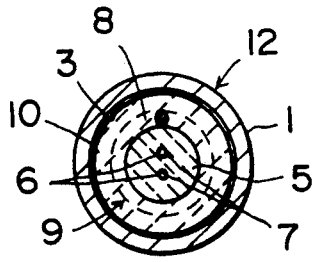
FIG. 4 is a sectional view taken along a line 4—4 in FIG. 3.

Now, one embodiment of this invention will be described by referring to FIGS. 3 and 4.

A sheathed heater 12 of the present invention comprises a metal pipe 1 made of stainless steel, iron or other heat resistive special steel having a bottom plate 2 made of the same material formed at the bottom portion thereof, a core of porcelain insulator 5 made by compacting magnesia or the like and arranged at the center of the metal pipe 1, and a pair of lead pins 7 of which base portions are inserted into small holes 6 formed passing through the core of porcelain insulator 5. Also provided are a heater coil 8 of nickrome wire wound around the core of porcelain insulator 5, and a heat resistive insulation material member 10 of magnesia or the like filled in a space formed between the metal pipe 1, the bottom plate 2, and the core of porcelain insulator 5. The pair of lead pins 7 are connected electrically to both ends of the heater coil 8, respectively, to form a heating element 9.

Before the sheathed heater is assembled, in accordance with the present invention, the entire inner peripheral surface 3 of the metal pipe 1 and the inner surface 3*a* of said bottom plate 2 are oxidized, respectively, or the outer peripheral surfaces of the heater coil 8 and the pair of lead pins 7 are oxidized by subjecting them to a higher temperature atmosphere in the presence of sufficient oxygen, or subjecting them to chemicals, such as an oxydizing agent.

Figure 5:
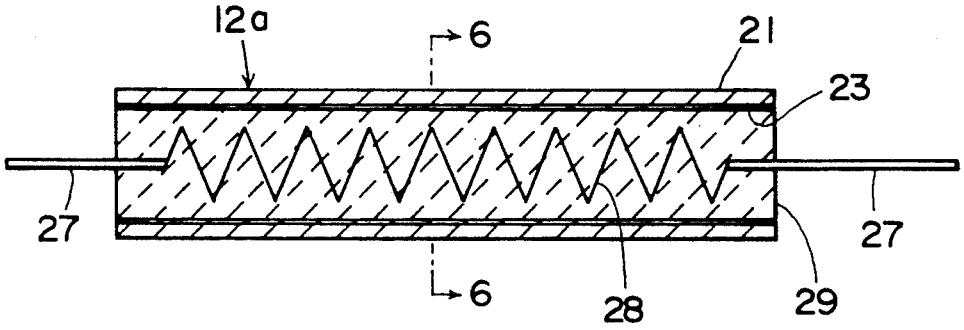
FIG. 5 is a sectional side view of a sheathed heater according to another embodiment of the present invention.
Figure 6:
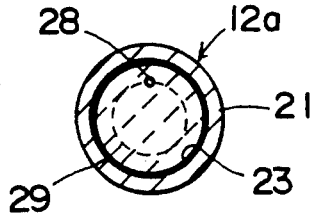
FIG. 6 is a sectional view taken along a line 6—6 in FIG. 5.

Another embodiment of the present invention will be explained with reference to FIGS. 5 and 6.

In this embodiment, a sheathed heater 12*a* is composed of a metal pipe 21 made of stainless steel, iron or another heat resistant special steel, and an internal heater coil 28 of nickrome wire inserted into the metal pipe 21. Also provided are lead pins 27 connected to both ends of the heater coil 28 and extending to the outside of the metal pipe 21, respectively, and a heat resistive insulation material member 29 of magnesia or the like filled in a space formed between the metal pipe 21 and the internal heat coil 28.

Before the sheathed heater is assembled, the inner peripheral surface 23 of the metal pipe 21 is oxidized, or the outer peripheral surfaces of said heater coil 28 and lead pins 27 are oxidized by subjecting them at a higher temperature atmosphere in the presence of sufficient oxygen, or subjecting them to chemicals, such as an oxydizing agent.

Figure 7:
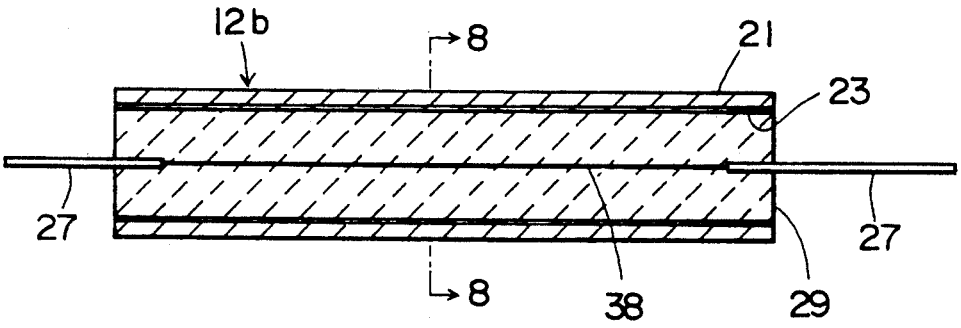
FIG. 7 is a sectional side view of a sheathed heater according to a further embodiment of the present invention.
Figure 8:
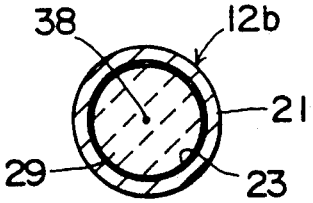
FIG. 8 is a sectional view taken along a line 8—8 in FIG. 7.

In a further embodiment of the present invention illustrated in FIGS. 7 and 8, an internal heater of a sheathed heater 12*b* is formed of a straight wire 38.

In all of the embodiments discussed above, a metal pipe having a circular cross section is used. However, it should be understood that a metal pipe having a rectangular cross section, triangular cross section, elliptic cross section or the like may be used.

The oxidization may be carried out by such a method that the metal pipe etc. is heated in an electric furnace containing sufficient air or oxygen at a temperature of about 300° to 1300° C. during from about 5 minutes to more than 10 hours, or at a temperature of about 1,000° to 1,300° C., during about 5 minutes to about 1 hour, until the color of the entire inner peripheral surface of the metal pipe etc. is turned to light brown, brown, or black. The weight of the metal surface being oxidized is increased by about 0.01 mg/cm$^2$ of oxidized surface by oxidation when the oxidized surface turns light brown.

In the other method, such oxidization is carried out by applying known chemicals, such as an oxidizing agent thereto.

By such oxidization, the insulation resistance of the oxide film thus formed becomes sufficiently large to reduce leakage current, even at temperature above 600° C.

According to the sheathed heater of the present invention, the leakage current can be reduced to between $\frac{1}{3}$ and 1/10 of that in conventional sheathed heaters, in case that the sheathed heater is used at a high temperature atmosphere of more than 600° C., because the metal pipe or the heater coil and the lead pins are oxidized fully and uniformly, and the insulation resistance of the oxide film thus formed is very high.

Thus, the present invention is effective to reduce the leakage current, thereby precluding the disadvantages associated with frequent activation of the circuit breaker inserted between the sheathed heater and the power source thereof, and the heating operation using the sheathed heater can be carried out efficiently and ecconomically.

What is claimed is:

1. A sheathed heater comprising:

a metal pipe of which the entire inner peripheral surface is oxidized, an internal heater inserted into said metal pipe and having opposed ends, lead pins connected to both ends of said heater, respectively, and a heat resistent insulation material member filled in a space formed between said metal pipe and said internal heater, wherein all of said inner peripheral surface of said metal pipe is oxidized to a degree which is sufficient to reduce leakage current, which would otherwise flow from said heater to said metal pipe when the heater is used in a high temperature atmosphere of more than 600° C., by at least $\frac{2}{3}$.

2. The sheathed heater according to claim 1, wherein said oxidization is carried out by subjecting said metal pipe to a high temperature atmosphere in the presence of sufficient oxygen to provide oxidation.

3. The sheathed heater according to claim 1, wherein the degree of said oxidization is such that the weight of said metallic material is increased more than about 0.01 mg/cm$^2$ of oxidized surface by the oxidization.

4. The sheathed heater according to claim 1, wherein said internal heater is in the shape of a coil.

5. The sheathed heater according to claim 1, further comprising a core of porcelain insulator arranged at the center of said metal pipe, wherein said internal heater comprises a coil wound around said core.

6. The sheathed heater according to claim 1, wherein said internal heater is a straight wire.

7. A sheathed heating comprising:

a metal pipe, an internal heater inserted into said metal pipe and having opposed ends, lead pins connected to both ends of said heater, respectively, and a heat resistent insulation material member filled in a space formed between said metal pipe and said internal heater, the outer surfaces of said internal heat and said lead pins being oxidized to a degree which is sufficient to reduce leakage current, which would otherwise flow from said heater to said metal pipe when the heater is used in a high temperature atmosphere of more than 600° C., by at least ⅔.

8. The sheathed heater according to claim 7, wherein said oxidization is carried out by subjecting said internal heater and said lead pins to a high temperature atmosphere in the presence of sufficient oxygen to provide oxidation.

9. The sheathed heater according to claim 1, wherein the degree of said oxidization is such that the weight of said metallic material is increased more than about 0.01 $mg/cm^2$ of oxidized surface by the oxidization.

10. The sheathed heater according to claim 7, wherein said internal heater is in the shape of a coil.

11. The sheathed heater according to claim 7, further comprising a core of porcelain insulator arranged at the center of said metal pipe, wherein said internal heater comprises a coil wound around said core.

12. The sheathed heater according to claim 7, wherein said internal heater is a straight wire.

13. A sheathed heater comprising:

a metal pipe, an internal heater inserted into said metal pipe and having opposed ends, lead pins connected to both ends of said heater, respectively, and a heat resistent insulation material member filled in a space formed between said metal pipe and said internal heater, the entire inner peripheral surface of said metal pipe, and the outer surfaces of said internal heater and said lead pins being oxidized, wherein (1) said inner peripheral surface of said metal pipe, and (2) the outer surface of said heater and said lead pins are oxidized to a degree which is sufficient to reduce leakage current, which would otherwise flow from said heater to said metal pipe when the heater is used in a high temperature atmosphere of more than 600° C., by at least ⅔.

14. The sheathed heater according to claim 13, wherein said oxidization is carried out by subjecting said metal pipe, internal heater and lead pins to a high temperature atmosphere in the presence of sufficient oxygen to provide oxidation.

15. The sheathed heater according to claim 1, wherein the degree of said oxidization is such that the weight of said metallic material is increased more than about 0.01 $mg/cm^2$ of oxidized surface by the oxidization.

16. The sheathed heater according to claim 13, wherein said internal heater is in the shape of a coil.

17. The sheathed heater according to claim 13, further comprising a core of porcelain insulator arranged at the center of said metal pipe, wherein said internal heater comprises a coil wound around said core.

18. The sheathed heater according to claim 13, wherein said internal heater is a straight wire.

19. A method of forming a sheathed heater exhibiting reduced current leakage under high temperature operation, comprising the steps of:

(A) providing 1) a metal pipe having an inner peripheral surface, and 2) a heater having lead pins attached to opposed ends thereof; and then (B) oxidizing an element of said heater to reduce the leakage current which would otherwise flow from said heater to said metal pipe when said heater is used in a high temperature atmosphere the oxidizing of said element comprising oxidizing at least one of 1) all of said inner peripheral surface of said pipe, and 2) outer surfaces of said heater and said lead pins; then (C) inserting said heater and said lead pins into said metal pipe; and (D) filling a space formed between said heater and said metal pipe with a member formed from heat resistant insulation material.

20. A process according to claim 19, wherein said step (B) comprises oxidizing said element to a degree which is sufficient to reduce leakage current, which would otherwise flow from said heater to said metal pipe when said heater is used in a high temperature atmosphere of more than 600° C., by at least ⅔.

21. A process according to claim 20, wherein the degree of said oxidization is that the weight of metallic material to be oxidized is increased more than about 0.01 $mg/cm^2$ of oxidized surface by the oxidization.

* * * * *